US008324989B2

(12) United States Patent
Hesselbarth

(10) Patent No.: US 8,324,989 B2
(45) Date of Patent: Dec. 4, 2012

(54) RE-ENTRANT RESONANT CAVITIES AND METHOD OF MANUFACTURING SUCH CAVITIES

(75) Inventor: Jan Hesselbarth, Dublin (IE)

(73) Assignee: Alcatel Lucent, Paris (FR)

( * ) Notice: Subject to any disclaimer, the term of this patent is extended or adjusted under 35 U.S.C. 154(b) by 128 days.

(21) Appl. No.: 11/524,111

(22) Filed: Sep. 20, 2006

(65) Prior Publication Data

US 2008/0067948 A1 Mar. 20, 2008

(51) Int. Cl.
*H01P 1/202* (2006.01)
*H01P 7/04* (2006.01)

(52) U.S. Cl. ..... 333/207; 333/224

(58) Field of Classification Search ..... 333/206–209, 333/222–226, 231–233
See application file for complete search history.

(56) References Cited

U.S. PATENT DOCUMENTS

| | | | | |
|---|---|---|---|---|
| 2,342,254 | A | 2/1944 | Dallenbach | |
| 3,733,567 | A * | 5/1973 | Johnson | 333/234 |
| 4,100,504 | A * | 7/1978 | McGann | 331/39 |
| 4,380,747 | A * | 4/1983 | Curtinot et al. | 333/202 |
| 4,477,786 | A * | 10/1984 | Tamura et al. | 333/207 |
| 4,890,054 | A * | 12/1989 | Maeno et al. | 324/640 |
| 5,285,178 | A | 2/1994 | Ahlberg | 333/224 |
| 5,329,687 | A | 7/1994 | Scott et al. | 29/527.2 |
| 6,130,189 | A * | 10/2000 | Matthaei | 505/210 |
| 6,255,917 | B1 | 7/2001 | Scott | 333/202 |
| 6,356,172 | B1 * | 3/2002 | Koivisto et al. | 333/231 |
| 6,611,183 | B1 * | 8/2003 | Peters | 333/206 |
| 6,992,548 | B2 * | 1/2006 | Fukunaga | 333/208 |
| 7,180,391 | B2 * | 2/2007 | Ala-Kojola | 333/207 |

FOREIGN PATENT DOCUMENTS

| | | |
|---|---|---|
| EP | 1544940 | 6/2005 |
| GB | 588183 | 5/1947 |
| WO | WO2004/084340 | 9/2004 |
| WO | PCT/US2007/019729 | 3/2008 |

OTHER PUBLICATIONS

Chi Wang et al, Modeling of Re-entrant Coaxial and Combline Resonators and Filters, 1996, IEEE, vol. 1, pp. 280-283.*
Definition of the word "about", www.merriam-webster.com, 2010.*
T. J. Mueller, "SMD-Type 42 GHz Waveguide Filter". Proc. IEEE Intern. Microwave Symp., Philadelphia, 2003, pp. 108901092.

(Continued)

*Primary Examiner* — Benny Lee
*Assistant Examiner* — Gerald Stevens
(74) *Attorney, Agent, or Firm* — Wall & Tong, LLP

(57) ABSTRACT

A re-entrant resonant cavity 12 includes a first metallized molded plastic component 18, which comprises a re-entrant stub 17, an end wall 14 and a cylindrical side wall 13. The component 18 is surface mount soldered to a metallized PCB substrate 19. A rostrum 24 is located facing the end face 21 of the stub 17 to define a capacitive gap 22 with it. The end face 21 of the stub 17 and the rostrum 24 are configured such that relative rotation between them changes the profile of the gap 22 and hence the gap capacitance. By suitably locating the two parts during manufacture, a particular capacitance may be chosen to give a desired resonance frequency from a selection available depending on the relative angular position of the stub 17 and rostrum 24. In another cavity, the rostrum is replaced by an etched metallization layer of a printed circuit board.

24 Claims, 4 Drawing Sheets

OTHER PUBLICATIONS

Lucent patent application, Hesselbarth 3, U.S. Appl. No. 11/523,998, filed Sep. 20, 2006, "Resonant Cavities and Method of Manufacturing Such Cavities".

Lucent patent application, Hesselbarth 4, U.S. Appl. No. 11/524,136, filed Sep. 20, 2006, "Re-Entrant Resonant Cavities, Filters Including Such Cavities and Method of Manufacture".

* cited by examiner

RE-ENTRANT RESONANT CAVITIES AND METHOD OF MANUFACTURING SUCH CAVITIES

FIELD OF THE INVENTION

The present invention relates to re-entrant resonant cavities and to a method of manufacturing such cavities. More particularly, but not exclusively, it relates to re-entrant cavities manufactured using surface mount techniques and to multi-resonator filter arrangements.

BACKGROUND OF THE INVENTION

A resonant cavity is a device having an enclosed volume bounded by electrically conductive surfaces and in which oscillating electromagnetic fields are sustainable. Resonant cavities may be used filters, for example, and have excellent power handling capability and low energy losses. Several resonant cavities may be coupled together to achieve sophisticated frequency selective behavior.

Resonant cavities are often milled in, or cast from, metal. The frequency of operation determines the size of the cavity required, and, in the microwave range, the size and weight are significant. In a re-entrant resonant cavity, the electric and magnetic parts of the electromagnetic field within the cavity volume are essentially geometrically separated, enabling the size of the cavity to be reduced compared to that of a cylindrical cavity having the same resonance frequency.

Since the geometrical shape of a resonant cavity determines its frequency of resonance, high mechanical accuracy is required and, in addition, or alternatively, post-production tuning is applied. For example, tuning mechanisms may be provided, such as tuning screws that project into the cavity volume by a variable amount and are adjusted manually. FIG. 1 schematically illustrates a re-entrant resonant cavity 1 which includes a manually adjusted tuning mechanism. The cavity 1 has an enclosed volume 2 defined by a cylindrical outer wall 3, end walls 4 and 5, and a re-entrant stub 6 extensive from one of the end walls 4. The electric field concentrates in the capacitive gap 7 between the end face 8 of the stub 6 and part 9 of the cavity wall 5 facing it. The end face 8 includes a blind hole 10 aligned with the longitudinal axis X-X of the stub 6. A tuning screw 11 projects from the end wall 5 into the hole 10. Energy is coupled into the resonant cavity and an operative monitors the effect on resonant frequency as he moves the tuning screw 11 in an axial direction relative to the end face 8, as shown by the arrow, to alter the value of the capacitance of the capacitive gap. This enables the resonance frequency of the cavity to be adjusted to the required value.

One known method for reducing the weight of a cavity is to manufacture it in plastic and cover its surface with a thin metal film. If milling is used to shape the plastic, it can be difficult to achieve sufficient accuracy, and surface roughness may be an issue. Molding is another approach, but the tooling is expensive, particularly when the cavities are combined together as a filter. In a typical multi-resonator filter, for example, the resonance frequencies of most of the included resonators differ from one another. The filter functionality requires slightly different resonance frequencies and therefore slightly different geometries for the resonators. As a consequence, if molding techniques are used, for example, plastics injection molding, a single molding form must be configured to define all of the resonators. Such a complex form is difficult to produce with sufficient accuracy, and hence incurs additional costs.

T. J. Mueller, "SMD-type 42 GHz waveguide filter", Proc. IEEE Intern. Microwave Symp., Philadelphia, 2003, pp. 1089-1092 describes manufacture of a waveguide filter using surface mount soldering in which a U-shaped metal filter part is soldered onto a printed circuit board (PCB), using the board metallization to define one of the waveguide walls.

BRIEF SUMMARY OF THE INVENTION

According to an aspect of the invention, in a method of manufacturing a re-entrant resonant cavity comprising an electrically conductive surface defining a volume and a re-entrant stub extensive into the volume and having a longitudinal axis and an end face, there being a capacitive gap between the end face and a facing portion of the surface, the method includes the steps of: providing a first cavity part which comprises the re-entrant stub; providing a second cavity part which comprises the facing portion; configuring the stub and the facing portion so that relative rotation between them about said longitudinal axis alters the profile of the capacitive gap to provide a gap capacitance for at least one relative rotational position which is different compared to that of another relative rotational position; and positioning the first and second cavity parts relative to one another to obtain a gap profile that gives a required gap capacitance.

By using the invention, the resonance frequency can be selected, for example, during placement of the first and second cavity parts by positioning them to obtain the appropriate angular displacement. This may be sufficient to eliminate the need for post-production tuning entirely if the parts are fabricated and located with sufficient accuracy, although additional tuning mechanisms may be included if necessary. Furthermore, the invention is suitable for automatic manufacture, reducing or eliminating the need for manual intervention in setting the resonance frequency.

The re-entrant stub and the facing portion are configured such that their effective overlap varies with their relative angular position. There are many possible shapes of the surfaces of the re-entrant stub and the facing portion which will exhibit the desired variation of gap capacitance with relative rotation of the components. Some shapes result in a larger capacitance variation over angular position than others, corresponding to a large frequency variation. A larger capacitance variation can be achieved by reducing the gap distance, that is, by making the gap smaller. Capacitance is inversely proportional to gap distance, as it is in a parallel plate capacitor.

The first cavity part may be of metallized plastic and formed by molding. The second cavity part may be carried by, and non-integral with, a substrate, such as, for example, a printed circuit board (PCB). Metallization on the surface of the PCB may define a surface of the cavity. The second cavity part may also be of molded metallized plastic, although it could alternatively be wholly of metal. The method may involve surface mount technology, soldering metallized plastic components into place. Their respective resonance frequencies can be adjusted during the placement and soldering phase of the technique. Thus, for example, the second cavity part may be surface mount soldered to a metallized PCB and the first cavity part mounted on the PCB also using surface mount techniques. Features provided by the PCB, or other substrate, may serve as location means to define the angular position of the first and second cavity parts. For example, the PCB may provide milled holes where the first and second cavity parts are located by means of pins or the like. Features such as pins can be added to a molded component by modification of the molding form at almost zero cost. The positions of the milled holes may be made different for each resonator of a filter at zero added cost, thereby achieving different resonance frequencies using the same resonator parts. Instead of using milled holes, or in addition thereto, the PCB could include etched features, or the footprint of the first cavity part could be elliptical, or otherwise non-cylindrical, resulting in an arrangement which is sensitive to angular position.

In an alternative method, the second cavity part is integrally formed with the cavity wall located opposite the end face of the stub in the finished cavity. However, this may lead to less design flexibility, as a larger component is required to be locatable in different angular positions relative to the first cavity part to give the required options for different capacitive gap profiles.

In another method in accordance with the invention, the second cavity part is defined by patterning a metallization layer on a substrate, such as a PCB substrate, for example.

By using the invention, identical first cavity parts may be included in respective re-entrant resonant cavities having different resonance frequencies. This enables overall tooling costs to be reduced, as the quantities are greater than is the case where each resonance frequency demands an individual molding form. This is particularly advantageous where a plurality of re-entrant resonant cavities is combined in a filter arrangement. Also, identical second cavity parts may be similarly be used in cavities required to have different resonance frequencies. Thus, a set of re-entrant resonant cavities may be manufactured with a range of resonance frequencies using just a single shape for each of the first and second cavity parts and, providing accuracy can be maintained during molding, soldering and placement, with no need for post-production manual tuning.

According to another aspect of the invention, a re-entrant resonant cavity comprises an electrically conductive surface defining a volume and including a re-entrant stub having an end face and a longitudinal axis, there being a capacitive gap between the end face and a facing portion of the surface, the configurations of the stub and the facing portion being such that relative rotation between them about said longitudinal axis would alter the profile of the gap to provide a gap capacitance for at least one relative rotational position which is different compared to that of another relative rotational position.

According to another aspect of the invention, a filter arrangement includes a plurality of re-entrant resonant cavities, at least one of which comprises: an electrically conductive surface defining a volume and including a re-entrant stub having an end face and a longitudinal axis, there being a capacitive gap between the end face and a facing portion of the surface, the configurations of the stub and the facing portion being such that relative rotation between them about said longitudinal axis would alter the profile of the gap to provide a gap capacitance for at least one relative rotational position which is different compared to that of another relative rotational position. The cavities may be mounted on a common substrate. Metallization on the substrate may be patterned, for example by etching, to define the second cavity parts, giving a compact and robust arrangement.

BRIEF DESCRIPTION OF THE DRAWINGS

Some methods and embodiments in accordance with the present invention will now be described by way of example only, and with reference to the accompanying drawings, in which.

DETAILED DESCRIPTION

Figure 2:
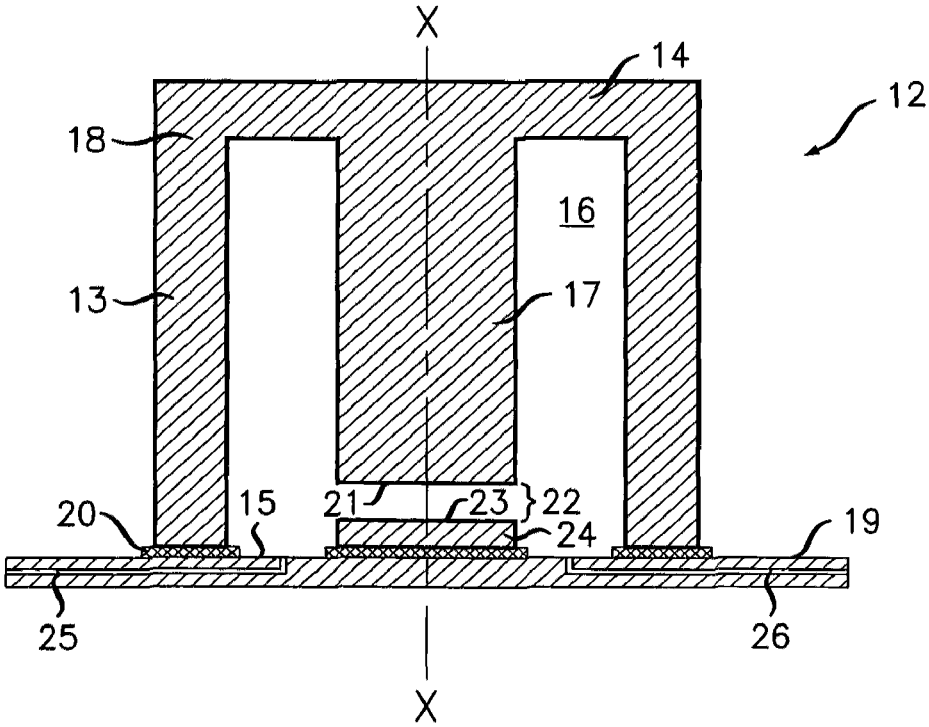
FIG. 2 schematically illustrates a re-entrant resonant cavity and method of manufacture in accordance with the invention.

With reference to FIG. 2, a re-entrant microwave resonant cavity 12 comprises a cylindrical wall 13, with first and second end walls 14 and 15 respectively at each end to define a volume 16 between them. A stub 17 is extensive from the first end wall 14 into the volume 16, being located along the longitudinal axis X-X of the cylindrical wall 13. The cylindrical wall 13, first end wall 14 and stub 17 are integrally formed as a single molded plastic component 18, the interior surface of which is metallized with a layer of silver. The second end wall 15 is defined by a metallization layer carried by a printed circuit board substrate 19. The cylindrical wall 13 is joined to the metallization layer by solder 20 laid down in a surface mount soldering process during fabrication of the device.

Figure 3:
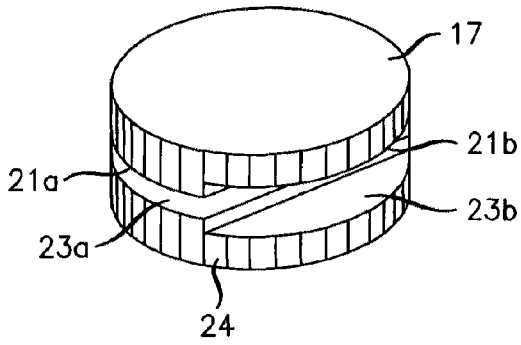
FIG. 3 schematically illustrates part of the re-entrant resonant cavity of FIG. 2 in greater detail.

The end face 21 of the stub 17 defines a gap 22 between it and the facing portion 23 of the second end wall 15. The facing portion 23 of the second end wall 15 is formed by a rostrum 24, which is of substantially the same diameter as that of the stub 17 in this embodiment. The rostrum 24 is a metallized molded plastic piece that is non-integral with the other parts of the cavity 12 and is soldered in place on the substrate 19. FIG. 3 shows the lower end of the re-entrant stub 17 and the rostrum 24 in greater detail. The end face 21 of the stub 17 is configured such that part 21*a* lies in one plane and another part 21*b* is in a different parallel plane, the boundary between them being across a diameter of the end face 21*b*. The facing portion 23 of the rostrum 24 also lies in different planes. A central portion 23*a* lies in one plane and side portions 23*b* (only one of which can be seen in FIG. 3) lie in a different plane.

The cavity 12 has an input for signal energy via a copper track 25 in the substrate 19 and an output via another copper track 26. These are used to couple energy into and out of the cavity volume 16, and allow the cavity 12 to be readily coupled to other similar cavities to form a filter, for example.

Figure 4A:
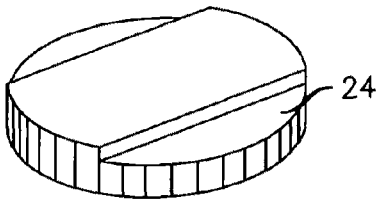
FIGS. 4(*a*) and 4(*b*) schematically illustrate a step in the method of FIG. 2.
Figure 4B:
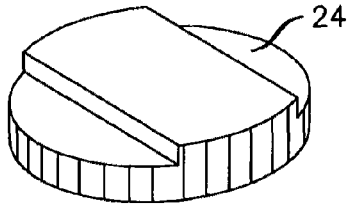

In manufacture of the cavity, firstly the single molded plastic component 18, which includes the stub 17, cylindrical wall 13 and end wall 14, is produced using injection molding. Metallization is applied to the surfaces that will be in the interior of the cavity in the finished device. The metallization is applied by spraying, although other methods are also possible to achieve a sufficiently complete coating for electrical purposes. The rostrum 24 is also injection molded and metallized. The rostrum 24 is then located on a solder pad carried by the metallized substrate 19. The angular position of the rostrum 24 with respect to the end face 21 of the stub 17 is selected so as to give the required capacitance in the gap between them. Thus, if the stub 17 is oriented as illustrated in FIG. 3, the rostrum 24 could be positioned as shown in FIG. 4(*a*) or as shown in FIG. 4(*b*), for example, relative to the stub 17. With the angular alignment shown in FIG. 4(*a*), the rostrum 24 and stub 17 are relatively positioned to provide maximum capacitance at the capacitive gap, whereas where the rostrum 24 is oriented as shown in FIG. 4(*b*) the relative positions provide minimum capacitance. Other intermediate positions provide gap capacitances between the maximum and minimum values.

Figure 1:
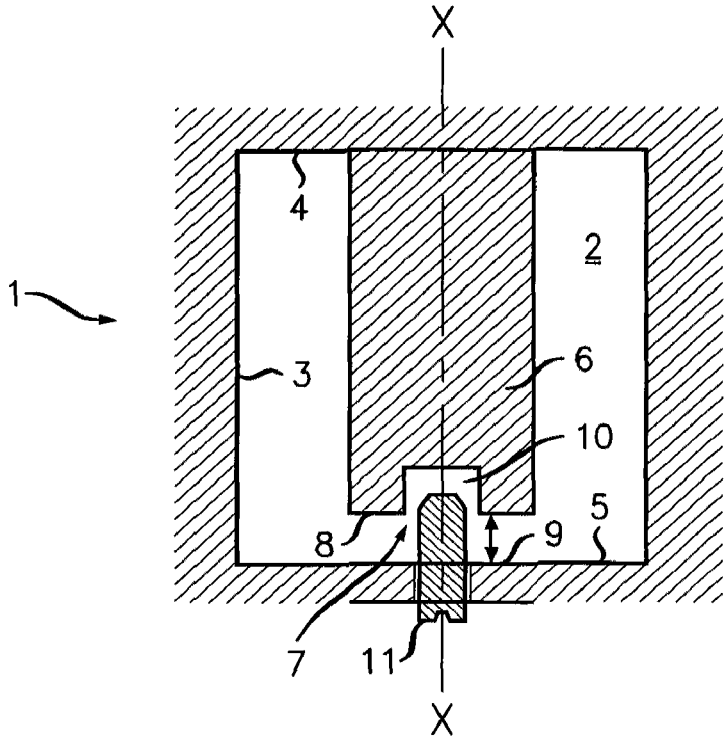
FIG. 1 PRIOR ART
FIG. 1 schematically illustrates a previously known re-entrant resonant cavity.
Figure 5:
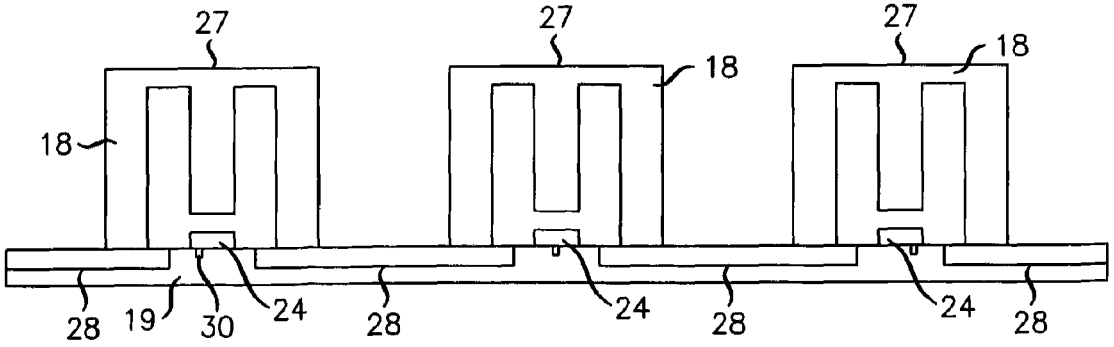
FIG. 5 schematically illustrates a filter arrangement including a plurality of re-entrant cavities.

With reference to FIG. 5, a filter includes a plurality of re-entrant resonant cavities 27, each being similar to that shown in FIG. 1, connected via conductive tracks 28 in a common substrate 29. The cavities include identical molded components 18 and identical rostrums 24. Each rostrum includes at least one locating pin 30 at its bottom surface. The printed circuit board substrate 29 includes a plurality of holes with which the locating pins interengage. During manufacture, each rostrum is located in the required angular orientation by the location of the holes prior to being soldered into position using surface mount technology. Thus, the resonant frequencies of the cavities can be made different while using identical cavity parts.

In other methods in accordance with the invention for manufacturing a filter, different rostrum configurations may be used with identical first cavity parts that include the stub. The benefits of being able to use identical, more complex, first cavity parts are still achieved, but making different shapes of rostrums available may increase the frequency range achievable with that shape of first cavity part. Also, not all of the resonant cavities included in a filter are necessarily of the type with which the present invention is concerned.

Figure 6:
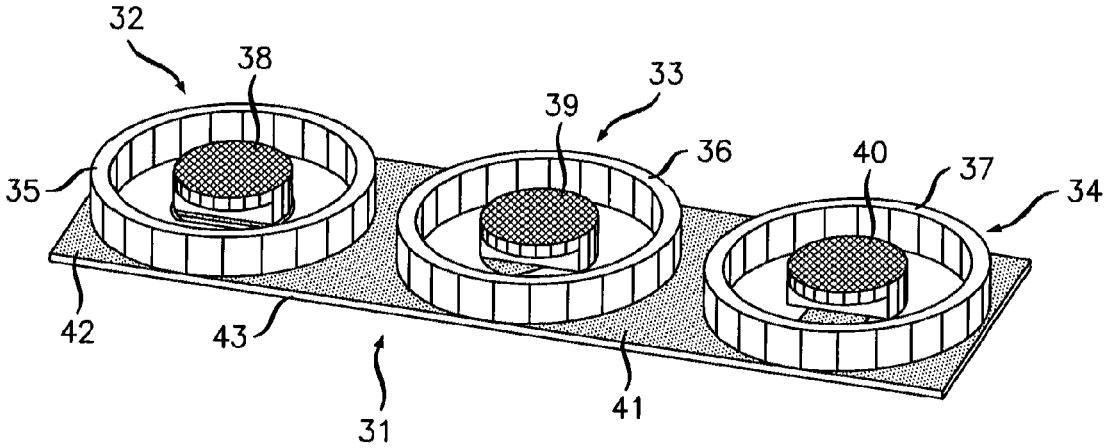
FIGS. 6 to 11 show components of another filter arrangement in accordance with the invention in which the second cavity parts are defined by planar metallization carried by a substrate.
Figure 7:
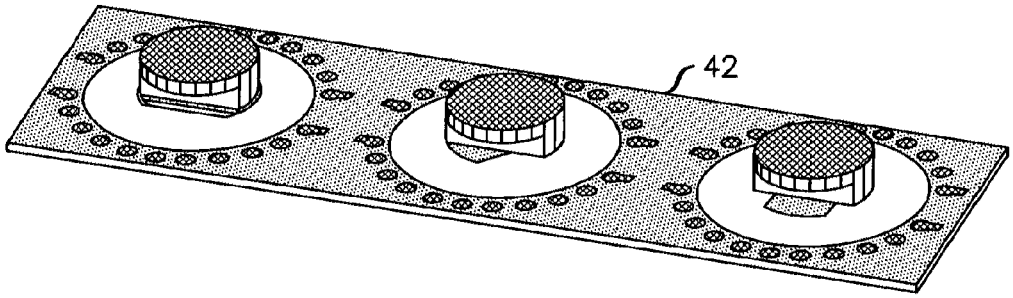

With reference to FIG. 6, a filter arrangement 31 includes three re-entrant resonant cavities 32, 33 and 34 each having a cylindrical wall 35, 36, 37 respectively and a centrally located re-entrant stub 38, 39 and 40 respectively. Each cavity also includes an end wall that is omitted in FIG. 6 for the sake of clarity. In each cavity, the cylindrical wall, stub and end wall joining them is formed as a single, metallized plastic, component fabricated by molding. As can be seen in FIG. 6, each stub has an end face that lies in more than one plane and is non-circularly symmetrical, and they are oriented in the same direction. The cylindrical walls 35, 36 and 37 are mounted on a PCB substrate 41 having a layer 42 of metallization on a dielectric layer 43, the cylindrical walls 35, 36 and 37 being soldered to the metallization layer 42. FIG. 7 is a similar view to that of FIG. 6, except that the cylindrical walls have been omitted to reveal patterning of the metallization layer 42 more clearly.

Figure 8:
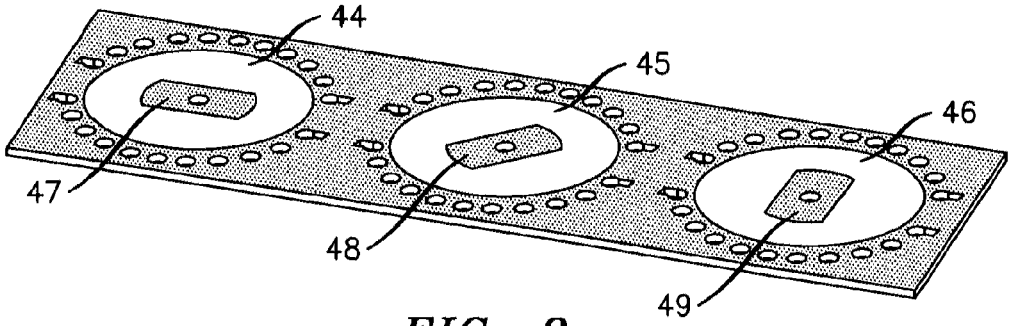

FIG. 8 shows the PCB substrate 41. The metallization layer 42 is etched so as to remove areas 44, 45 and 46 of metal, leaving non-circular patches 47, 48 and 49 of metal. The non-circular patches 47, 48 and 49 are the second cavity parts of the cavities 35, 36 and 37 respectively in the complete filter arrangement 31. The patches 47, 48 and 49 are oriented in different angular positions, so that, in combination with their respective stubs 38, 39 and 40, different gap capacitances, and hence different resonance frequencies for the cavities 32, 33 and 34, result.

Figure 9:
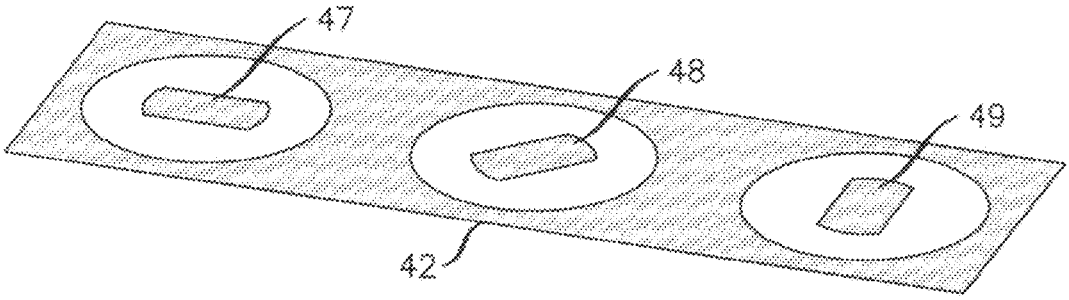
Figure 10:
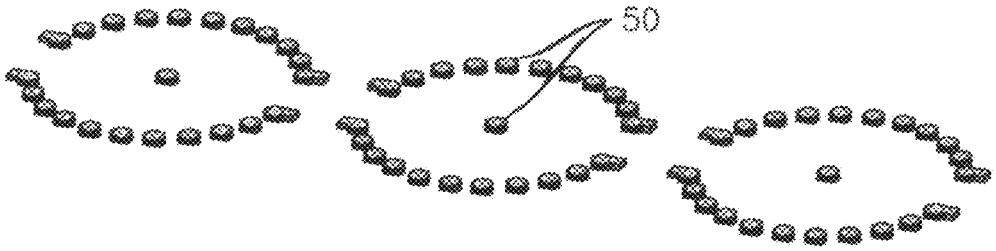
Figure 11:
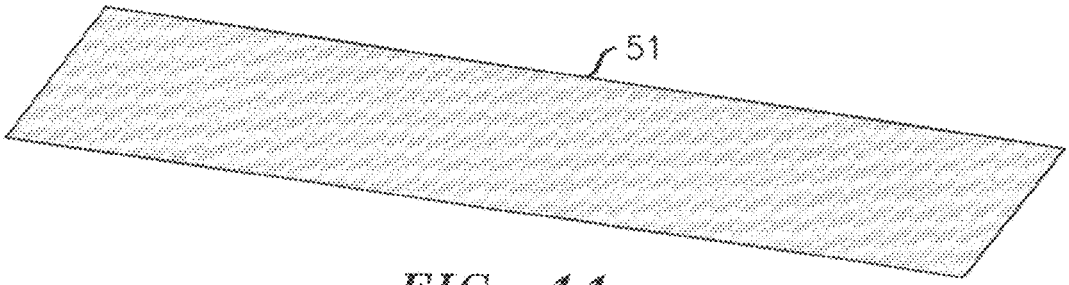

FIG. 9 shows only the top metal layer 42 of the substrate 41. FIG. 10 illustrates the pattern of metal-filled holes 50 in the dielectric layer 43 of the substrate 41 that underlies the metallization layer 42. The holes 50 connect the etched metallization layer 42 with a second metal layer 51 on the other side of the dielectric layer 43. The second metal layer 51 defines part of the electrically conductive cavity surface defining the volume within which an electromagnetic field is established during operation of each cavity. The second metal layer 51 is continuous, as shown in FIG. 11. However, the second metal layer 51 may include openings to allow coupling of signals into and out of the cavities. The PCB substrate 41 may comprise additional layers, for example, to include coupling copper traces embedded in a multilayer dielectric construction.

The present invention may be embodied in other specific forms, and implemented by other methods, without departing from its spirit or essential characteristics. The described embodiments and methods are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A method of manufacturing a re-entrant resonant cavity comprising an electrically conductive surface defining a volume and a re-entrant stub extending into the volume and having a first central longitudinal axis and an end face, there being a capacitive gap between the end face and a facing portion of the electrically conductive surface and the end of the stub and the facing portion being configured so that the end of the re-entrant stub and the facing portion are non-planar such that a spatially dependent gap distance is defined, the method including the steps of: providing a first cavity part as a metallized plastic component that integrally comprises the re-entrant stub and a first end wall of the cavity; providing a second cavity part which comprises the facing portion, the facing portion having a second central longitudinal axis; configuring the re-entrant stub and the facing portion so that, with no relative movement in the longitudinal axial direction, and with the first central longitudinal axis and the second central longitudinal axis longitudinally aligned, relative rotation between the re-entrant stub and the facing portion about said first and second central longitudinal axes alters the profile of the capacitive gap at least in part by changing the gap distance in at least a portion of the capacitive gap to provide a gap capacitance for at least one relatively rotated position which is different compared to that of another relatively rotated position; and positioning the first and second cavity parts relative to one another to obtain a gap profile that gives a required gap capacitance.

2. The method as claimed in claim 1 and wherein the first cavity part is formed by molding.

3. The method as claimed in claim 1 and wherein the first cavity part further integrally comprises: a cylindrical wall; the re-entrant stub; and the first end wall;

the re-entrant stub being surrounded by the cylindrical wall and extending from the first end wall in a direction along a longitudinal axis of the cylindrical wall.

4. The method as claimed in claim 1 and wherein the second cavity part is carried by a substrate.

5. The method as claimed in claim 4 and wherein the substrate is a printed circuit board substrate.

6. The method as claimed in claim 4 and including the step of joining the first cavity part and the substrate by surface mount soldering.

7. The method as claimed in claim 4 and wherein the substrate includes location means for angular positioning of the second cavity part.

8. The method as claimed in claim 4 and wherein the substrate is a metallized substrate and the second cavity part is defined by patterning the metallized substrate.

9. The method as claimed in claim 8 wherein the substrate is a printed circuit board substrate.

10. The method as claimed in claim 1 and wherein the end face of the re-entrant stub lies in two parallel planes.

11. The method as claimed in claim 1 and wherein the facing portion is in two parallel planes.

12. The method as claimed in claim 1 and including the steps of manufacturing a plurality of re-entrant resonant cavities that includes said re-entrant resonant cavity and connecting said plurality of re-entrant resonant cavities together to form a filter arrangement.

13. The method as claimed in claim 12 and wherein at least some re-entrant resonant cavities of the plurality each include an identical first cavity part and have different resonance frequencies.

14. The method as claimed in claim 13 and wherein the first cavity parts are of metallized molded plastic.

15. The method as claimed in claim 13 and wherein said at least some re-entrant resonant cavities each include an identical second cavity part.

16. The method as claimed in claim 12 and wherein the plurality of re-entrant cavities is carried on a common substrate.

17. The method as claimed in claim 16 and including the step of providing location means in the common substrate for relatively locating the first and second cavity parts of respective re-entrant cavities of said plurality of re-entrant resonant cavities.

18. The method as claimed in claim 16 and including the step of patterning a metallization layer carried by the substrate to define second cavity parts of the plurality of re-entrant cavities.

19. A re-entrant resonant cavity comprising an electrically conductive surface defining a volume and including a re-entrant stub having an end face and a first central longitudinal axis, there being a capacitive gap between the end face and a facing portion of the electrically conductive surface and the end of the re-entrant stub and the facing portion being configured so that the end of the re-entrant stub and the facing portion are non-planar such that a spatially dependent gap distance is defined, the facing portion having a second central longitudinal axis, the configurations of the re-entrant stub and the facing portion being such that, with no relative movement in the longitudinal axial direction and with the first central longitudinal axis and the second central longitudinal axis being longitudinally aligned, relative rotation between the re-entrant stub and the facing portion about said first and second central longitudinal axes would alter the profile of the gap at least in part by changing the gap distance in at least a portion of the capacitive gap to provide a gap capacitance for at least one relative rotational position which is different compared to that of another relative rotational position, and the re-entrant stub and a first end wall of the cavity being integrally part of a metallized plastic component.

20. A filter arrangement including a plurality of re-entrant resonant cavities, at least one of the plurality of re-entrant resonant cavities comprises: an electrically conductive surface defining a volume and including a re-entrant stub having an end face and a first central longitudinal axis, there being a capacitive gap between the end face and a facing portion of the electrically conductive surface and the end of the re-entrant stub and the facing portion being configured so that the end of the re-entrant stub and the facing portion are non-planar such that a spatially dependent gap distance is defined, the facing portion having a second central longitudinal axis, the configurations of the re-entrant stub and the facing portion being such that, with no relative movement in the longitudinal axial direction and with the first central longitudinal axis and the second central longitudinal axis being longitudinally aligned, relative rotation between the re-entrant stub and the facing portion about said first and second central longitudinal axes would alter the profile of the gap at least in part by changing the gap distance in at least a portion of the capacitive gap to provide a gap capacitance for at least one relative rotational position which is different compared to that of another relative rotational position, and the re-entrant stub and a first end wall of the cavity being integrally part of a metallized plastic component.

21. The filter arrangement as claimed in claim 20 and wherein at least some of said plurality of re-entrant resonant cavities comprise a component that includes said re-entrant stub which is identically shaped for respective different ones of said plurality of re-entrant resonant cavities, and said re-entrant stub being in a different angular relationship with the respective facing portion such that respective different gap capacitances are provided by said at least some of said plurality of re-entrant resonant cavities.

22. The filter arrangement as claimed in claim 21 and wherein the facing portion of the electrically conductive surface is provided by a second cavity part and identically shaped second cavity parts are included in said at least some of said plurality of re-entrant resonant cavities.

23. The filter arrangement as claimed in claim 20 and wherein said plurality of re-entrant resonant cavities is carried on a metallized substrate and patterning of the metallized substrate defines second cavity parts.

24. The filter arrangement of claim 23 and wherein the metallized substrate is a printed circuit board.

* * * * *